United States Patent [19]

Newmeyer

[11] 3,949,355

[45] Apr. 6, 1976

[54] SENSOR FOR VEHICULAR TRAFFIC DATA ACCUMULATING SYSTEMS

[76] Inventor: Reed A. Newmeyer, AMF Box 22207, Salt Lake City, Utah 84122

[22] Filed: Feb. 7, 1975

[21] Appl. No.: 547,927

Related U.S. Application Data

[63] Continuation of Ser. No. 402,170, Oct. 1, 1973.

[52] U.S. Cl. ..... 340/38 R; 307/265

[51] Int. Cl.[2] ..... G08G 1/00

[58] Field of Search ..... 340/38 R

[56] References Cited

UNITED STATES PATENTS

| | | | |
|---|---|---|---|
| 2,639,093 | 5/1953 | Hall | 340/38 R |
| 2,663,867 | 12/1953 | Favara | 340/38 R |
| 2,877,454 | 3/1959 | Zedlar | 340/38 R |
| 3,573,724 | 4/1971 | Komorida | 340/38 R |

*Primary Examiner*—Thomas B. Habecker
*Attorney, Agent, or Firm*—Herbert E. Haynes, Jr.

[57] ABSTRACT

A pneumatic road tube, a pressure responsive transducer, and an electronic circuit provide a vehicle sensor mechanism for use in a traffic data accumulating system. A complex air wave is produced within the tube each time a vehicle axle runs over the tube, these waves are sensed by the transducer which responds by producing an electric output signal indicative thereof. The transducer output signals are coupled to the electronic circuit which amplifies weak signals and blanks out unwanted portions thereof to produce signals suitable for application to the data accumulating device. The electronic circuit may be present by an operator to accurately respond to the various types of transducer output signals produced by slow, medium, or high speed traffic.

6 Claims, 2 Drawing Figures

SENSOR FOR VEHICULAR TRAFFIC DATA ACCUMULATING SYSTEMS

This is a continuation of application Ser. No. 402,170, filed Oct. 1, 1973.

BACKGROUND OF THE INVENTION

1. Field of the Invention

This invention relates to sensing devices and more particularly to a vehicle sensor mechanism for use in a vehicular traffic data accumulating system.

2. Description of the Prior Art

Traffic data accumulating systems are used for gathering various types of information regarding traffic movements such as: vehicular speed, direction, time, for counting purposes, and the like. These systems have traditionally employed a vehicle sensing mechanism which includes an elongated hollow pneumatic road tube which is stretched across one or more traffic lanes in a roadway. The tube is closed on one end and has its other end connected to a diaphragm switch. When the axle of a vehicle passes over the tube, an air pressure wave is generated within the tube, this wave displaces the diaphragm to mechanically operate a set of electrical contacts. A data accumulating device such as a recorder, is connected to the electrical contacts and records each time these contacts close.

This diaphragm switch, or any other similar mechanically operated device, is hereinafter referred to as a digital switch due to the output signal being digital in nature. The digital switches have proven to be the most inaccurate portion of the system due to their inability to accurately respond to the variety of complex air pressure waves created within the pheumatic tube.

The air pressure waves created within the tube are complex in that they are multi-pulse oscillating waves of various amplitudes, pulse widths, and frequencies. Several factors effect the characteristics of these wave forms such as: speed of the traffic, weight of the vehicle, tire width, location along the length of the tube where the vehicle contacts the tube, and wave attenuation.

High speed traffic produces a wave having a high amplitude, short pulse width, and high frequency. Lower speed traffic produces a wave having lower amplitude, longer pulse width, and lower frequency. Heavy vehicles create a wave having higher amplitude than the wave created by a lighter vehicle. Wide tires displace more air within the tube than does a narrow tire.

The attenuation of an air pressure wave increases approximately as the square of the inside diameter of the tube decreases. That is, a tube having an inside diameter of 3/16 inch will attenuate a wave more than a tube of ⅜ inch inside diameter. Other conditions which effect attenuation of the pressure wave are tube length, wall thickness, and tube condition.

A relatively light vehicle which contacts the road tube in the proximity of the digital switch produces a signal which easily operates the switch. When the same vehicle contacts the tube on its other end, the wave may be attenuated along the length of the tube to a point where it is of insufficient amplitude to activate the switch.

Another problem effecting the accuracy of such devices, is waves which may be defined as spurious waves. Under ideal conditions, each axle of the vehicle which contacts the road tube will, for all practical purposes, produce a single legitimate complex air pressure wave. However, as is quite often the case, an axle will produce more than one complex air pressure wave, and all waves over one are considered as spurious waves. One example of spurious waves is sometimes referred to as a reflected wave, that is, one which bounces off of the closed end of the road tube. Another type of spurious pressure wave, which is particularly troublesome at lower vehicular speeds, is one which occurs when all of the wheels of an axle do not contact the road tube at the same time, thus producing two separate complex pressure waves.

It may be apparent from the foregoing brief description of the complexity of air pressure waves and the occurrence of spurious air pressure waves, that vehicular traffic sensor mechanisms must be able to respond to a tremendous variety of legitimate pressure waves and also must be able to distinguish between legitimate and spurious waves in order to achieve any degree of accuracy.

The digital switch type of prior art sensor mechanisms all tend to be inaccurate due to the plurality of individual pulses within a single air pressure wave which cause the switch contacts to chatter. This type of device is also incapable of distinguishing between a legitimate air pressure wave and a spurious wave.

A particular prior art device which alleviated the problems of the complexity of legitimate air pressure waves and of spurious air pressure waves is fully disclosed in U.S. Pat. No. 3,699,398, issued on Oct. 17, 1972 to the same inventor. Briefly, this device, hereinafter referred to as the Analog Self-Adjusting Switch type of prior art device, employs an electromagnetic transducer which senses the air pressure wave produced within the pneumatic road tube and electromagnetically induces a voltage which is coupled to an electronic circuit. This type of device is called an Analog Self-Adjusting Switch due to the characteristics of the induced voltage being determined by the characteristics of the air pressure waves sensed. The electronic circuit blanks out unwanted portions of the voltage and responds to the remaining portion thereof by producing a single output signal for each pressure wave. This output signal is shaped and timed by the electronic circuit so as to be independent of the characteristics of the air pressure wave. This blanking out capability is just as effective in handling the complexity of spurious pressure waves as it is in handling the complexity of legitimate pressure waves. Therefore, the electronic circuit is provided with a signal interrupting means which, after the circuit has produced an output signal, interrupts the ability of the circuit to produce an additional output signal for a predetermined length of time. This interrupting feature prevents voltages induced by spurious pressure waves from producing a second output signal for the same axle.

This Analog Self-Adjusting Switch type of prior art unit was found to be extremely accurate and it solved the problems of the complexity of the legitimate air pressure waves and the spurious pressure waves when those waves are produced by normal highway traffic where devices of this type are usually employed.

Highway traffic is considered to be normal when the average speed of the vehicles is above 20 miles per hour, with the speeds below that minimum figure being hereinafter referred to as low speed traffic.

Traffic data accumulating systems of these types which are employed to monitor normal traffic movements are usually not employed to monitor low speed traffic movements as monitoring of low speed traffic is difficult and at best very inaccurate. However, a need exists for monitoring of such traffic as would occur, for example, at the drive-in window of some business establishments, such as banks.

The percentage of error is increased in all prior art traffic data accumulating systems of the above types which attempt to monitor low speed traffic.

The Analog Self-Adjusting Switch type of prior art has a problem due to the air pressure waves being of low amplitude, long pulse width and low frequency. Signals of this type are usually too weak to activate this type of sensor and errors result. One method of solving, or at least reducing the percentage of error resulting from these weak signals, is to employ a road tube having a larger inside diameter than is normally used. This results in greater amplitude and less attenuation of signals, and signals having sufficient strength to activate the sensor usually result. This type of large bore road tube cannot be used to sense normal traffic movement as the pressure waves produced thereby will often be strong enough to damage the equipment due to overloading. Therefore, this method of solving the weak signal problem is not practical from a cost or convenience standpoint as the tube must be changed for each type of traffic movement to be monitored. Another method of solving the problem was attempted; namely, increasing the sensitivity of the device to render it capable of reacting to the weak signals. This second method also proved inadequate as overloading also occurred when monitoring of normal traffic was attempted.

The digital type of prior art switch may also experience difficulties with weak pressure waves, however, this problem is solved in this type of unit by adjusting the sensitivity.

The problem of spurious air pressure waves, such as those which occur when the wheels of an axle contact the tube at different times, are compounded in low speed traffic monitoring to a point where even the Analog Self-Adjusting Switch type of prior art device is no longer effective in handling this problem. The length of time between the legitimate air pressure wave and any spurious pressure waves is so great in low speed traffic that the duration of output signal interrupt provided by the signal interrupting means is too short to prevent the spurious waves from producing additional output signals. If this duration is increased in the analog switch type prior art device, then the duration will be too long for normal traffic monitoring purposes.

In view of the foregoing, a need exists for an improved sensor mechanism for use in data accumulating systems which may be employed to monitor either low, medium, or high speed traffic movements.

SUMMARY OF THE INVENTION

In accordance with the invention, an improved sensor mechanism for use in vehicular traffic data accumulating systems is disclosed.

A pressure sensitive transducer is employed to sense a vehicle input signal in the form of an air pressure wave created by the axle of the vehicle contacting the pheumatic road tube. Dynamic amplitude range reducing means is employed between the road tube and the transducer to attenuate the strong air pressure waves generated by medium or high speed traffic and which allows the weaker air pressure waves produced by low speed traffic to pass with little or no attenuation. The transducer responds to the attenuated air pressure waves by producing an analog voltage, the characteristics of which are determined by the characteristics of the attenuated air pressure wave.

The analog voltage is coupled to an electronic circuit which amplifies low frequency voltages more than high frequency voltges, blanks out unwanted portions of the voltage and responds to the remainder thereof by producing a single outut signal. Once the circuit has produced this output signal, it is interrupted as to its ability to produce an additional output signal for a predetermined length of time, thus preventing any spurious pressure waves from producing extra output signals. The predetermined length of time that the circuit is prevented from producing extra output signals may be adjusted by an operator to accommodate the pressure waves produced by either low, medium or high speed traffic.

Accordingly, it is an object of the present invention to provide a new and improved vehicular sensor mechanism for use in traffic data accumulating systems.

Another object of the present invention is to provide an improved vehicle sensor mechanism which produces a single output signal in response to input signals produced by each axle of a vehicle contacting a pneumatic road tube. The mechanism may be operator adjusted so as to respond accurately to the input signals produced by vehicles travelling either at low, medium or high speeds.

The foregoing and other objects of the present invention, the various features thereof, as well as the invention itself, may be more fully understood from the following description when read in conjunction with the accompanying drawings.

DESCRIPTION OF THE PREFERRED EMBODIMENT

Figure 1:
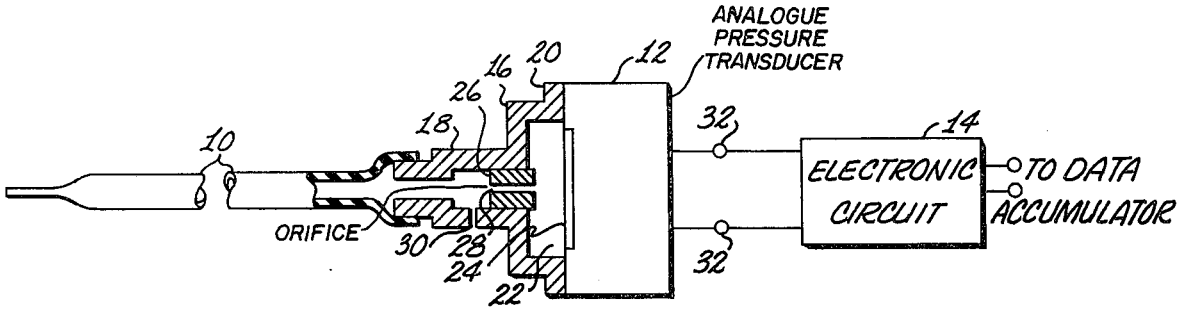
FIG. 1 is an illustration in schematic form of a vehicular sensor mechanism of the present invention and illustrating various elements thereof.

Referring more particularly to the drawings, FIG. 1 illustrates a road tube 10, a pressure sensitive transducer 12 and an electronic circuit 14. These elements in combination comprise the preferred embodiment of vehicular traffic sensor mechanism of the present invention.

The road tube 10 is an elongated hollow pneumatic tube formed of resilient material such as rubber. The fabrication and operating characteristics of the tube 10 are well known in the art.

An air pressure wave is transmitted along the length of the tube 10 each time the axle of a vehicle runs over the tube. This air pressure wave is of a complex nature and may be generally defined as a multi-pulse oscillating wave of decreasing amplitude. The amplitude, pulse width and frequency of the wave are determined by several factors such as: vehicle weight, tire size, speed of the vehicle, condition and length of the tube 10 and the point along the length of the tube at which the vehicle runs over the tube.

A housing 16 is connected to one end of the road tube 10 such as by a boss 18 or other suitable fitting. The housing may be provided with a flange 20 upon which the pressure sensitive transducer 12 is mounted so as to form a chamber 22 between the boss 18 and a pressure sensitive surface 24 of the transducer. It should be understood that the housing 18 may be formed to completely enclose the transducer 12.

The transducer 12 may be any of several well known types of devices such as electromagnetic, piezioelectric, resistive, and the like; so long as it responds to pressure by producing an analog voltage the characteristics of which are determined by the characteristics of the air pressure wave.

Air pressure waves produced by a vehicle contacting the road tube 10 are transmitted through the boss 18 into the chamber 22 of housing 16 and will impinge upon the pressure sensitive surface 24 of the transducer 12. The transducer responds to the impinging air pressure by producing a voltage which is coupled to the electronic circuit 14 as will hereinafter be described in detail.

The air pressure waves produced within the road tube 10 will vary as previously described, and the dynamic ranges that the transducer 12 and the electronic circuit 14 would be called upon to respond to could be excessive if left unchecked. For example, a vehicle travelling at a high rate of speed will produce a wave having a high amplitude and this same vehicle travelling at a lower rate of speed will produce a wave having a lower amplitude. The dynamic range between the low amplitude and the high amplitude could cause overloading of the transducer. Overloading of the electronic circuit 14 could also result and damage thereto could occur.

To prevent overloading of the pressure transducer 12 and the electronic circuit 14, the air pressure waves (or vehicle generated pulses) are dynamically amplitude reduced and allowed to enter the chamber 22 of the housing 16. This amplitude reduction is accomplished by a restrictor in the form of an insert 26 having an orifice 28 formed therethrough, the orifice being installed in the boss 18 of the housing. The diameter of the orifice 28 is small in comparison with the diameter of the sensitive surface 24 of the pressure transducer 12. Since the orifice 28 is small, high amplitude pressure waves (or pulses) of short duration generated by high speed traffic will only partially pass through the restrictively small diameter orifice 28. Thus, the amplitude of the pressure in chamber 22 is less than the amplitude before entering the orifice 28.

Low speed traffic generates waves (or pulses) of relatively low amplitude and long time duration. The orifice 28 will cause very little attenuation of such waves produced by low speed traffic due to a greater amount of time being available for raising the pressure in chamber 22 to more nearly equal the pressure before entering the orifice 28. Thus, the orifice 28 allows low speed traffic produced air pressure waves, or pulses, to pass through with very little amplitude reduction. The foregoing explains how the dynamic range of pressure waves within the road tube 10 are reduced to allow the sensitive surface 24 of the transducer 12 to operate without overload and the resulting damage.

An ambient pressure equalizing port 30 is formed in the boss 18 of the housing 16 and must be of relatively small diameter so as not to reduce the effect of the air pressure waves. It should be noted that this pressure equalizing port could be installed in one wall of the housing 16 (not shown) so as to act on the pressure within the chamber 22. However, due to the extremely small diameter that would be required if the port were so formed, it is more practical from a cost and manufacturing standpoint to place the port 30 in the boss 18.

The analog voltage produced by the transducer 12, in response to the pressure impinging on the pressure sensitive surface 24, will possess the characteristics of the pressure wave such as the amplitude and pulse width and will be in proportion thereto. This analog voltage is applied to a pair of output terminals 32 which are coupled to the electronic circuit 14.

Figure 2:
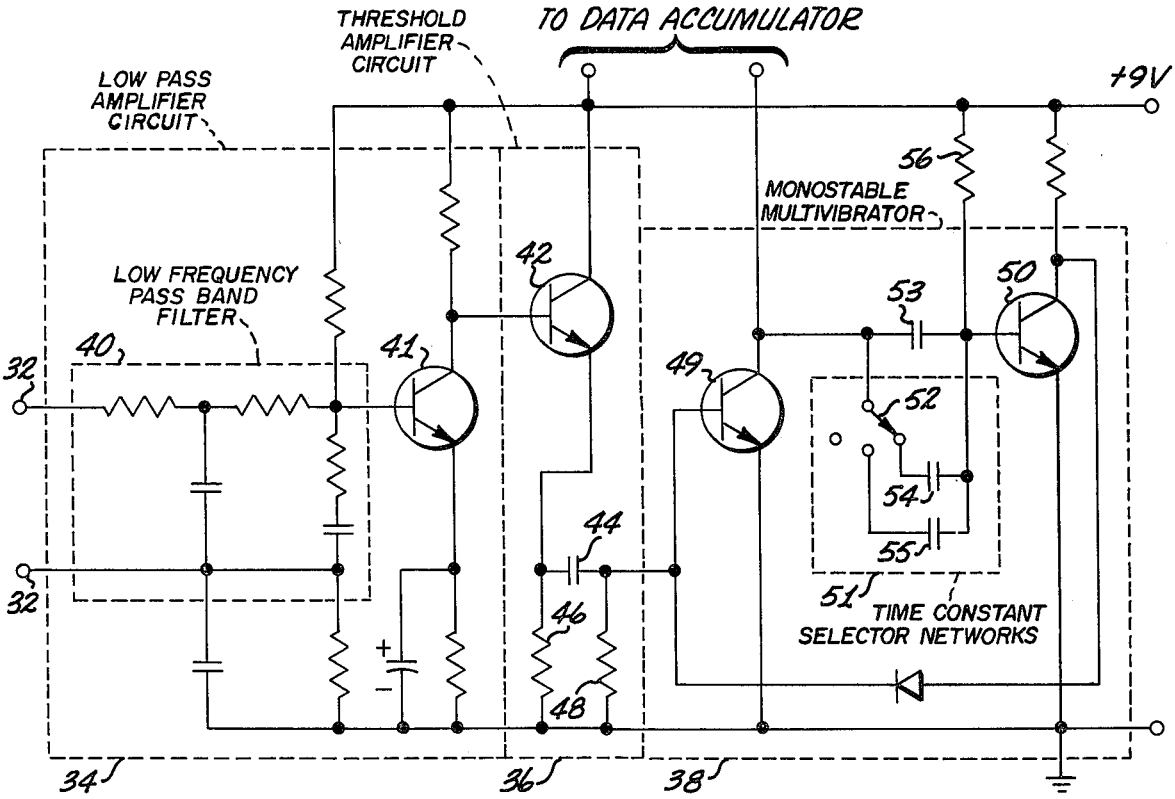
FIG. 2 is a diagrammatic illustration of the electronic circuit portion of the present invention.

With reference now to FIG. 2 wherein the electronic circuit 14 is shown in detail. The circuit 14 includes a low pass amplifier circuit 34 for passing low frequency signals with less attenuation than high frequency signals and amplifying those passed signals. Also included is an amplifier which is hereinafter referred to as a variable threshold amplifier circuit 36 due to its function of discriminating against signals of lesser amplitude that the bias of that circuit. Finally, the circuit 14 includes a monostable multivibrator 38 with an adjustable output pulse period.

The analog voltage present at the output terminals 32 of the transducer 12 is coupled to the low pass amplifier circuit 34 which will raise the pulse amplitude of the low frequency voltages resulting from the low frequency air pressure waves produced by low speed traffic. The low pass amplifier circuit 34 is of a type well known in the art and may be seen to include a low pass filter 40 which allows the low frequency signals to pass through with less attenuation than the high frequency signals. Also included in the low pass amplifier circuit 34 is a transistor 41 which, along with its associated components, provides the necessary amplification.

The output signal from the low pass amplifier circuit 34 is coupled to a transistor 42 which is part of the variable threshold circuit 36. The transistor 42 multiplies (amplifies) the signal which maintains the transistor 42 in the conductive state as long as the voltage value of this signal is rising. The output signal from the transistor 42 is coupled to a capacitor 44 and charges that capacitor to a value determined by the amplitude of the signal applied thereto from the transistor 42. The capacitor 44 of the variable threshold amplifier circuit 36 is charged on the positive going edge of the first pulse of the signal at transistor 42. The capacitor 44 charges very quickly because there are no resistors in series with the positive going charge path. The charge thus accumulated on capacitor 44 will bleed off very slowly due to the large value of resistance of resistors 46 and 48 in series. The residual charge on capacitor 44 serves as the threshold bias for transistor 42. This threshold bias prevents the transistor 42 from turning on in response to signals of a lower amplitude than the residual charge, or bias, on the capacitor 44. The value of resistor 48 is in the range of 1/5 to 1/20 of the value of resistor 46 and provides the reference to ground for the capacitor 44.

The capacitor 44 a.c. couples this signal to the adjustable monostable multivibrator 38 and is therefore the output signal from the threshold circuit 36.

The transistor 42, the capacitor 44, and a pair of resistors 46 and 48 comprise the threshold circuit 36, the output signal of which has a predetermined decay or time constant. This decay time of the output signal from the threshold circuit 36 will typically be in the range of from 50 to 1000 milliseconds.

It may be seen that the threshold sensitivity increases as the capacitor 44 discharges. Also, the threshold value of the output signal will be low when weak signals are received from the low pass amplifier circuit 34 and will be high when strong signals are received therefrom. Thus, the decaying output signal from the threshold circuit 36 will automatically be adjusted to a new level when the capacitor 44 is recharged.

A vehicle passing over the road tube 10 will cause a multi-pulse air pressure wave to be produced within the tube, this pressure wave in turn will cause a multi-pulse electric signal to be produced by the transducer 12 as hereinbefore described. The initial pulse of the pressure wave is larger in amplitude than any subsequent pulses of the same wave. Therefore, the initial pulse of the transducer produced signal is larger in amplitude than any subsequent pulses produced by the same pressure wave. Thus, the initial pulse of the transducer output signal, after being conditioned by the low pass amplifier circuit 34, will charge the capacitor 44 to a higher level than could be achieved by the subsequent pulses. It may now be easily seen that the initial charge on the capacitor 44 will produce a decaying output signal from the threshold circuit 36 which will mask or blank out subsequent signals which would otherwise result from the same pressure wave or reflections thereof.

In some instances, a single set of vehicle wheels may cause a second distinct air pressure wave which is of higher amplitude than the first pressure wave, and this second pressure wave could result in double counting of a vehicle's axle. Some examples of conditions which may cause this second air pressure wave are, whipping of the road tube 10, or a vehicle passing over the tube so that the two wheels of the same axle do not contact the tube simultaneously.

To insure that a single output signal is produced by the electronic circuit 14 for each axle of a vehicle, the output signal from the threshold circuit 36 is coupled to the adjustable monostable multivibrator means 38.

The adjustable monostable multivibrator means responds to the output signal from the variable threshold circuit 36 by relaying the occurrence of that signal to a suitable traffic data accumulating device (not shown) by producing an output signal, and then preventing additional output signal production for a predetermined length of time.

Monostable multivibrators, or one shots, are well known in the art, therefore, the principles and operation thereof will only be briefly described. A monostable multivibrator is a device which produces an output signal for a predetermined length of time upon being triggered by an input signal applied thereto. Once a monostable multivibrator is triggered, no subsequent triggering signals applied thereto will effect it during its operating period. Thus, it may be seen that a monostable multivibrator is an ideal device for performing the relaying of the occurrence of an output signal from the threshold circuit 36, and then interrupting additional production of an output signal for a predetermined time.

Usually the time constant of a monostable multivibrator, that is, the length of time that it operates to produce an output signal, is a fixed value, and that value is determined by the specific values of the circuit components. Due to the previously described wide range of vehicular traffic speeds that the sensor mechanism of the present invention must respond to, a conventional monostable multivibrator, as described above, has been modified for this particular application. In addition to the usual transistors 49 and 50, the monostable multivibrator 38 is provided with the components necessary to provide a plurality of time constants and also includes means by which an operator may select the particular time constant best suited for the average speed of the traffic to be monitored.

The need for a plurality of selectable time constants may be more easily understood upon consideration of the following two factors. The first factor is that the time differential between the first (legitimate) air pressure wave and the second (spurious) air pressure wave produced by the same axle of a vehicle will be quite long when that vehicle is moving at a low rate of speed. In this situation the time constant will have to be long to prevent the second pressure wave from producing an extra output signal for that axle. The second factor to be considered is the high repetition rate of legitimate air pressure waves which are produced by high speed traffic some of which would be missed if the time constant of the monostable multivibrator were too long. Thus, to allow the sensor mechanism of the present invention to be suitable for use in all types of traffic conditions the monostable multivibrator 38 is provided with the plurality of selectable time constants.

To accomplish this feature of selectable time constants, the monostable multivibrator 38 includes a time constant selector means 51. The preferred embodiment of the time constant selector means 51 includes a three position switch 52 which may be moved by an operator to place either capacitor 53, 54, or 55, each with a different value, in series with the resistor 56 so that three distinct RC networks may be employed in the circuitry of the monostable multivibrator.

Experiments have determined that three distinct time constants are sufficient for most highway traffic monitoring situations, however, it should be understood that more or less time constants can be provided as needed. The following table may be informative in understanding the relationships between traffic speeds and the need for a plurality of time constants.

| Average Speed | Time Constant |
|---|---|
| 50 MPH | 20 Milliseconds |
| 25 MPH | 40 Milliseconds |
| 12 MPH | 80 Milliseconds |
| 6 MPH | 160 Milliseconds |
| 3 MPH | 320 Milliseconds |

It should also be understood that the above described method of implementing the selectable time constant feature of the present invention is but one method of several which could be employed. An alternate method would be to vary the value of resistor 56 such as by substituting three resistors of different values (not shown) and selecting a desirable one of them as accomplished with capacitors 53, 54, and 55, or by replacing resistor 56 with a potentiometer (not shown). Another reasonable method would be to vary the potential to which capacitor 53 is charged by connecting that capacitor to the wiper lead of a potentiometer (not shown). One lead of the potentiometer would be connected to the emitter of the transistor 49 of the one shot 38 with the other lead of the potentiometer connected to the collector of this same transistor. Changing the setting of a potentiometer connected in this fashion would change the time constant of the monostable multivibrator, and the settings could be related to M.P.H. on a dial (not shown) for operator use.

Employing the monostable multivibrator 38 to accomplish the signal interrupting function, as hereinbefore described, results in two additional features which are desirable in most applications. These features are related to the output signal produced by the monostable multivibrator 38, in that each output signal will have substantially the same amplitude and substantially the same pulse width regardless of the characteristics of the triggering signal. These features result from the inherent properties of the monostable multivibrator 38 and are desirable in that they shape and time the signal as required by some traffic data accumulating systems.

It should be understood that the functions of the monostable multivibrator, as described above, could be accomplished by methods and apparatus other than the one shot.

By way of example, the output signal from the threshold circuit 36 could be coupled directly to the traffic data accumulating device (not shown) through a suitable, normally closed, electric switch (not shown). The same signal could simultaneously be coupled through a delay circuit (not shown) to a timing device (not shown) which would open the switch for a predetermined time. The timing device (not shown) could also be variable to adapt this type of apparatus to the various traffic speeds to be monitored. This apparatus therefore opens the signal path from the threshold circuit 36, rather than the saturated condition maintained by the monostable multivibrator 38 of the preferred embodiment.

This latter apparatus provides the necessary signal interrupting function but lacks the features of shaping and timing the output signals as is inherent with the monostable multivibrator 38. However, these features are not always required by the traffic data accumulating device.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A sensor mechanism for use in a vehicular traffic data accumulating system comprising:

a. a pneumatic road tube having at least one open end, said tube producing multipulse pressure waves within the hollow bore thereof when contacted by the wheels of one axle of the vehicle;

b. means connected to the open end of said pneumatic road tube for reducing the dynamic amplitude range of the pressure waves passing therethrough;

c. a pressure sensitive transducer coupled to receive the pressure waves from said means for reducing the dynamic amplitude range of the pressure waves and generating analog electric signals in response thereto, the generated analog electric signals having characteristics determined by the characteristics of the pressure waves; and d. an electronic circuit coupled to receive the analog electric signals from said pressure sensitive transducer and produce a single pulse output signal for the pressure waves produced by the one axle of the vehicle.

2. A sensor as claimed in claim 1 wherein said means for reducing the dynamic amplitude range of the pressure waves comprises a restrictor having a predetermined orifice formed therethrough.

3. A sensor as claimed in claim 1 wherein said electronic circuit comprises:

a. a low pass amplifier circuit means having a relatively low frequency pass band filter and an amplifier, said low pass amplifier circuit means coupled to receive the analog electric signals from said pressure sensitive transducer for passing relatively low frequency signals with less attenuation than relatively high frequency signals and amplifying those passed signals;

b. a threshold amplifier circuit means including an amplifier and means for biasing thereof so that the amplifier will discriminate against signals of lesser amplitude than the bias, said threshold amplifier circuit means coupled to receive the signals from said low pass amplifier circuit means and produce at least one output signal in response thereto; and c. a monostable multivibrator means coupled to receive the output signal produced by said threshold amplifier circuit means and produce a single output signal in response thereto for a predetermined time.

4. A sensor as claimed in claim 3 wherein said monostable multivibrator means includes means for selecting the length of time that said monostable multivibrator will produce the single output signal.

5. A sensor as claimed in claim 1 wherein said electronic circuit comprises:

a. a low pass amplifier circuit means having a relatively low frequency pass band filter and an amplifier, said low pass amplifier circuit means coupled to receive the analog electric signals from said pressure sensitive transducer for passing relatively low frequency signals with less attenuation than relatively high frequency signals and amplifying these signals;

b. a variable threshold amplifier circuit means including an amplifier and means for biasing thereof, said variable threshold amplifier circuit means coupled to receive the signals from said low pass amplifier circuit means and respond thereto by producing an output signal the value of which is determined by the highest pulse amplitude of the analog electric signals received, the output signal produced by said variable threshold amplifier circuit means having a predetermined decay time for masking lower pulse amplitudes of the analog electric signals received; and c. a monostable multivibrator means coupled to receive the output signal from said variable threshold amplifier circuit means and respond thereto by producing a single output signal for a predetermined time, said monostable multivibrator means including means for optionally selecting the length of time that said monostable multivibrator will produce the single output signal.

6. A sensor as claimed in claim 5 wherein the means for optionally selecting the length of time that said monostable multivibrator will produce the single output signal comprises a plurality of optionally selectable time constant networks.

* * * * *